US006270683B1

(12) United States Patent
Turner

(10) Patent No.: US 6,270,683 B1
(45) Date of Patent: Aug. 7, 2001

(54) SWIMMING POOL SKIMMING APPARATUS

(76) Inventor: William E. Turner, 2920 Turner Dr., Calumet, OK (US) 73036

( * ) Notice: Subject to any disclaimer, the term of this patent is extended or adjusted under 35 U.S.C. 154(b) by 0 days.

(21) Appl. No.: 09/694,043

(22) Filed: Oct. 20, 2000

(51) Int. Cl.[7] ..... E04H 4/16
(52) U.S. Cl. ..... 210/776; 210/169; 210/242.1
(58) Field of Search ..... 210/169, 776, 210/242.1

(56) References Cited

U.S. PATENT DOCUMENTS

| | | | | |
|---|---|---|---|---|
| 4,089,074 | | 5/1978 | Sermons . | |
| 5,043,060 | * | 8/1991 | Brennan | 210/169 |
| 5,139,660 | * | 8/1992 | Louri et al. | 210/169 |
| 5,173,181 | | 12/1992 | McFarland . | |
| 5,264,122 | | 11/1993 | Lakotish . | |
| 5,279,728 | | 1/1994 | Weiss . | |
| 5,288,414 | | 2/1994 | Mongiello . | |
| 5,350,508 | * | 9/1994 | van der Watt | 210/169 |
| 5,422,001 | | 6/1995 | Yagodo et al. . | |
| 5,487,830 | * | 1/1996 | Huppert | 210/169 |
| 5,705,058 | * | 1/1998 | Fischer | 210/169 |
| 5,759,388 | | 6/1998 | Cote . | |
| 5,849,184 | | 12/1998 | Veillet . | |
| 5,911,878 | | 6/1999 | Benvenuto . | |
| 5,951,858 | * | 9/1999 | Soto et al. | 210/169 |
| 6,132,604 | * | 10/2000 | Kirchoff | 210/169 |

* cited by examiner

*Primary Examiner*—Robert Popovics
(74) *Attorney, Agent, or Firm*—James F. Harvey III

(57) ABSTRACT

An apparatus for skimming floating debris from an enclosed pool of water wherein a circular current of water occurs, said apparatus comprising a frame defining an inlet portion positioned upstream and an outlet portion covered with netting positioned downstream. A collection basket, also covered with netting and located at one end of the inlet portion, extends upstream from and with its open end perpendicular to the inlet portion so that the leading edge of the collection basket sufficiently impedes the current along its permeable leading edge. This impediment induces a lateral current internal to the apparatus which causes a substantial portion of the floating debris entering the apparatus to be accumulated in the collection basket out of the main flow of the current, rather than accumulating at the netting-covered outlet portion of the apparatus. This lateral collection area with its accompanying lateral current flow improves the ability of the apparatus to prevent debris from leaving the apparatus once captured.

20 Claims, 2 Drawing Sheets

SWIMMING POOL SKIMMING APPARATUS

BACKGROUND OF THE INVENTION

The current invention relates to the field of passive cleaning devices for swimming pools, and particularly to an improved, stationary apparatus for collecting floating debris in swimming pools having a circulatory current therein.

Cleaning a swimming pool of debris is a common problem among pool owners. Such debris may enter swimming pools from many different sources. Wind and rain carry falling leaves, insects, dust, twigs and other objects onto the surface of the water in the pool where it may float for a period of time before sinking to the bottom. It is desirable to remove such debris before it becomes waterlogged and sinks to the bottom of the swimming pool, since the cleaning of bottom-resident debris by means of vacuum devices is labor intensive and costly.

The prior art is replete with devices for skimming floating debris. Most such devices have a frame and netting construction. Handheld devices rely on human action to sweep the skimmer along the pool's surface to entrap floating debris, while passive devices are fixed along the edge of the pool and rely upon circular around the perimeter of the pool which are produced by the water jets of the pool filtration pump. These currents may be further enhanced by the Coriolis effect, which in the Northern Hemisphere is manifested by a tendency for objects moving in a straight line to move right, or clockwise. These passive devices are partially submerged in a pool with the inlet or water intake leading to a collection area. The inlet faces into the circulating water current, which flows through the device and exits through an outlet. Debris is caught in the netting at the collection area, which is generally colocated with the outlet.

For example, U.S. Pat. No. 5,849,184 discloses a device having an elongated inlet portion and a similarly elongated collection portion extending the width of the device, the inlet portion being positioned perpendicular to the flow of water.

U.S. Pat. No. 4,089,074 discloses a triangular-shaped frame supporting a net with the inlet side of the triangle perpendicular to the flow of water and a collection area at the apex opposing the inlet side. The current flows through the inlet portion and out through the collection portion, which collects debris in the main current flow.

U.S. Pat. No. 5,264,122 discloses a floating stationary pool cleaner having a collection portion and an inlet portion but with integral water jets directing the floating debris into the inlet portion. As with U.S. Pat. No. 4,089,074, the current flows through the inlet portion and out through the collection portion, which collects debris in the main current flow.

U.S. Pat. No. 5,173,181 discloses an apparatus for positioning the detachable strainer from a manual pool scoop in an orientation perpendicular to the flow of the water in the pool, by means of a bracket attached to the pool's side. It has an inlet and collection portion as well.

U.S. Pat. No. 5,279,728 discloses a basket or collection portion to receive debris from the circular flow in a pool. A tube and nozzle arrangement directs a forced flow of water through the basket portion, thus, presumably creating a circular current within the pool.

U.S. Pat. No. 5,288,414 discloses another supporting device for a collection portion, in which the collection portion for skimming debris is supported by a support member attached to the side of the pool and a float around the neck of the support member.

U.S. Pat. No. 5,759,388 discloses yet another stationary skimming device floating on the surface of the pool, having an inlet portion perpendicular to the flow of water and a collection portion at the opposing end, similar to that of U.S. Pat. No. 4,089,074.

U.S. Pat. No. 5,911,878 discloses another passive pool skimmer with an elongated inlet portion and an outlet portion of roughly the same extent. It is non-rigidly secured to the side of the pool and is configured so that it does not present a hazard to swimmers.

However, all such pool skimmers share the same problem, namely, that debris has a tendency to float out of the skimmer collection area when a certain amount of debris is collected; the debris can thus reenter the swimming pool where it either sinks to the bottom or else is collected again by the skimmer. This phenomenon has been observed to a greater or lesser extent in all such pool skimmers.

This observed phenomenon is believed to be caused by the following actions. The general circular pool current brings debris into the skimmer collection area and flows on through the netting collecting the debris. The current as it flows through the skimmer tends to keep the debris against the netting comprising the outlet portion. As the debris accumulates against the netting, the current flowing through the skimmer from its inlet to its outlet portions is reduced and the force keeping the debris against the netting of the outlet portion is lessened. As the current through the skimmer becomes weaker, the force keeping the debris against the netting of the outlet portion is weakened, thus allowing the trapped debris to float forward towards the inlet portion against the current. Eventually the debris escapes the skimmer and is reintroduced into the swimming pool. It is also observed that the netting itself presents resistance to the swimming pool current; this resistance can be increased by using a finer mesh netting or some other permeable material, or decreased by using a coarser mesh. The accumulation of debris at the outlet portion forces pool owners to frequently clean the outlet/collection area in order to keep the circulatory pool current path clear and unimpeded. If the debris could be removed from the collection area before it could accumulate and impede water flow out the outlet area, then the skimmer could operate more efficiently for longer periods.

In prior art, cleaning the pool skimmer is an tedious task. Most devices use a form of netting as the filter means. The advantage of using a netting for snagging and holding debris also serves as a disadvantage in the cleaning process. Removing the debris from the netting while the netting is attached to the device often is awkward and difficult.

Thus, it can be seen that there is a need for a pool skimmer which effectively traps increased amounts of debris without allowing the trapped debris to be reintroduced into the swimming pool after capture. The skimmer should also be easily cleaned.

DISCLOSURE OF THE INVENTION

It is thus an object of this invention to more efficiently collect debris than heretofore.

It is a further object of this invention to collect debris by altering the circulatory current through a mesh resistance means on the water inlet area of the pool skimmer.

It is a further object of this invention to provide a removable mesh filter to improve the cleaning and removal of debris.

It is a further object of this invention to provide a means for collecting floating debris in such a way as to prevent the collected floating debris from inhibiting the current flow therethrough, and thus provide increased capacity and longer intervals between cleaning.

The invention resides not in any one of these features, per se, but rather in the particular combination of all of the herein disclosed and claimed. It is distinguished from the prior art in this particular combination of all of its structures for the functions specified. These and other objects of the invention may be more clearly seen from the detailed description of the preferred embodiment which follows.

SUMMARY OF THE INVENTION

The present invention consists of a net supported by a longitudinal frame having a rectangular inlet positioned so that the circular pool current directs debris through the inlet to be caught by the net. In addition, the invention features a collection basket positioned at one end of the device and including a portion of the inlet but wherein the opening of the basket is parallel to the current flow through the inlet. The collection basket is located upstream of the main inlet area and also covered with a netting or some other permeable material. An unexpected result is observed in this arrangement. The positioning of a basket upstream of the inlet portion of the skimmer creates an observable secondary cross current flowing across the main current and through the collection basket, the area immediately upstream of the inlet, and the main portion of the longitudinal frame. This secondary current which is induced by the resistance of the leading edge of the collection basket and the permeable material on the leading edge of the basket tends to sweep debris from the main portion of the longitudinal frame and keeps it clear of debris which might inhibit free flow of water therethrough. A majority of the floating debris is thus captured in the collection basket where it remains until it is removed from the apparatus or until it becomes waterlogged, in which case it sinks to be captured in the portion of the basket which extends below the surface of the water. In this manner, the invention is able to capture increased amounts of debris without clogging, and this increased time results in greater time between cleaning of the apparatus.

DETAILED DESCRIPTION OF THE PREFERRED EMBODIMENT

Figure 1:
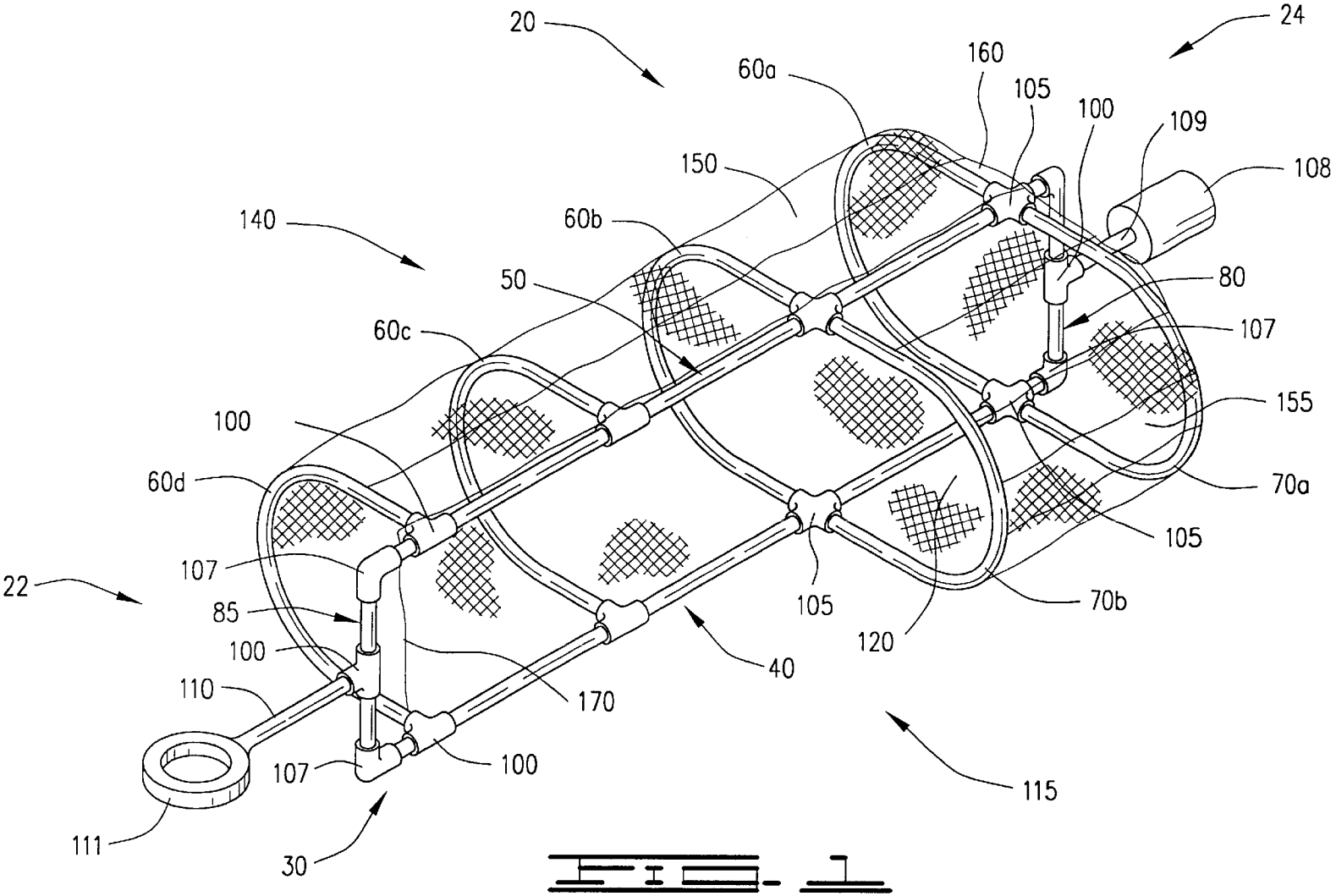
FIG. 1 shows a full three dimensional isometric view of the pool skimmer.

Referring to FIG. 1 which gives a front perspective view of the invention, pool skimmer 20 is shown generally having a proximal end 22 for stationary connection (not shown) with the edge of a swimming pool and a distal end 24 projecting into the interior of the swimming pool. skimmer 20 is formed of a frame 30 constructed of any light material which can be formed into a frame to support netting. The preferred choice of material is polyvinyl chloride tubing as is commonly found in swimming pool equipment. The netting which is referenced in the remaining text may be composed of any permeable material which allows a current of water to flow through; however, it has been found that the preferred choice is a plastic or nylon netting material with a suitable mesh to entrap small particles of debris commonly found around the typical home. In the description that follows, the forward direction is considered to be a direction against the current and a rear direction is considered to be with the current.

Frame 30 is comprised of an upper frame member 40 and a lower frame member 50, both extending longitudinally between the proximal end 22 and the distal end 24. Frame members 40, 50 are held in constant spaced relation by distal vertical member 80 and proximal vertical member 85. Vertical members 80, 85 are connected to the ends of frame members 40, 50 by L-couplings 107 to form a generally rectangular structure. Rear ribs 60*a*, 60*b*, 60*c*, and 60*d* are spaced along the rear side of frame members 40, 50 and between vertical members 80, 85. Rear ribs 60*c*, 60*d* are positioned towards the proximal end 22 of frame 20, with the first ends of rear ribs 60*c* and 60*d* are connected to upper frame member 40 by a standard T-coupling 100 and the second ends of said ribs are connected to lower frame member 50 by a standard T-coupling 100. Rear ribs 60*a*, 60*b* are positioned towards the distal end 24 of frame 20. Front ribs 70*a* and 70*b*are spaced distally along the same side of frame members 40, 50 and oppose rear ribs 60*a* and 60*b*, respectively. The first ends of ribs 60*a*, 70*a* and 60*b*, 70*b* are each connected to upper frame member 40 by a standard X-coupling 105 and the second ends of ribs 60*a*, 70*a* and 60*b*, 70*b* are connected to lower frame member 50 by a standard X-coupling 105.

Conceptually, the skimmer structure can be described as a frame to which is connected a side-mounted collection basket consisting of front ribs 70*a*, 70*b* and rear ribs 60*a*, 60*b*, interconnected by a portion of frame members 40, 50 and vertical frame member 80, the open face of which basket is defined by ribs 60*b*, 70*b*. Alternatively, the skimmer structure can be described as a net structure consisting of a netting supported by a frame consisting of rear mounted ribs 60*a–d*, upper and lower horizontal members 40, 50, and vertical members 80, 85, and having a collection scoop mounted at one end of the inlet portion and consisting of the forward mounted frame comprising ribs 70*a*, 70*b*.

Skimmer 20 is rigidly attached to a support (not shown) on the side of the 5 swimming by means of proximal horizontal support member 110 and a support means 111. Any such support means is contemplated, such as by clamps, screws, rings, and the like, wherein the support means rigidly suspends skimmer 20 so that it is half immersed longitudinally beneath the surface of the swimming pool. Optionally, float 108 may be connected to distal end 24 for floating support of skimmer 20, such connection being accomplished by means of distal horizontal support member 109 attached to an L-coupling 100 along vertical frame member 80, so as to reduce the supporting requirements for support means 111.

Frame 30 supports netting having a fine mesh suitably sized to allow water to pass through but to restrict most small particles of debris. A rear netting portion 150 of generally rectangular shape is attached along the length of upper frame member 40 and is wrapped around rear ribs 60*a–d* to attach along the length of lower frame member 50. attachment may be accomplished by any suitable means, and the preferred manner of attachment is by a hook and loop arrangement commonly known to the industry. A front netting portion 155, also of generally rectangular shape, is attached along upper frame member 40 between front ribs 70*a*, 70*b* and is wrapped around rear ribs 70*a*, 70*b* to attach along lower frame member 50 between front ribs 70*a*, 70*b*. A distal netting portion 160 extends over distal end 24 of pool skimmer 20, attaching to the distal edges of front netting portion 155 and rear netting portion 150, conceptually forming a collection basket. A proximal netting portion 170 extends over proximal end 24 of pool skimmer 20, attaching to the proximal edge of rear netting portion 150. Note that although the netting covering skimmer 20 has been described as four individual portions, the actual construction of the netting may be as a single piece cut appropriately or as multiple pieces which functionally cover the frame as described.

The rectangular area defined by upper frame member 40 and lower frame member 50 and between rear ribs 60*b* and 60*d* define an inlet portion 115 which is unobstructed by netting. The area comprising the rear netting portion 150 is defined as the outlet portion 140. The collection area comprises the netting portion forming a conceptual basket on distal end 24 of skimmer 20, namely, the area within distal netting portion 160, forward netting portion 155, and rear netting portion 150.

Figure 2:
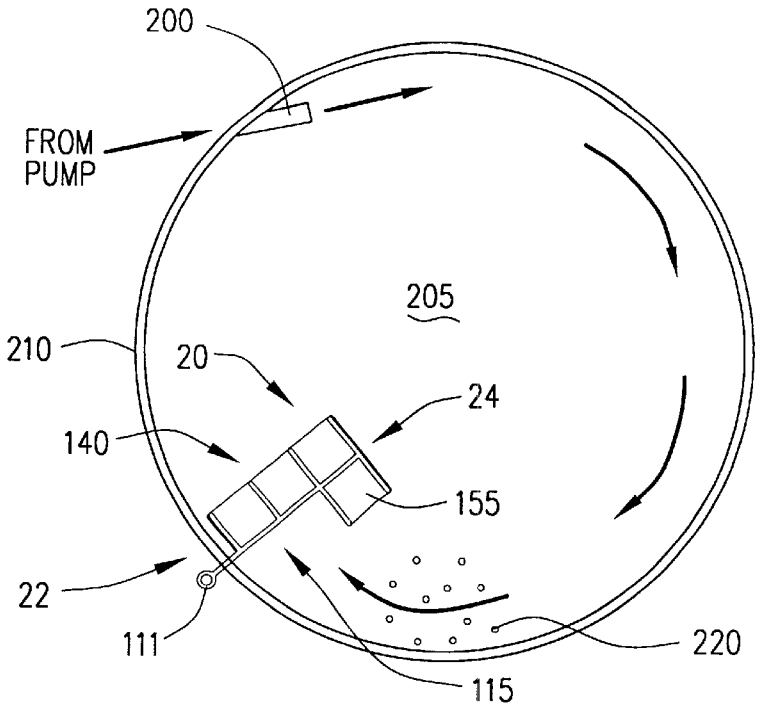
FIG. 2 presents an overhead view of the pool skimmer as it is positioned within a swimming pool

Referring to FIG. 2, pool skimmer 20 installed for use in a swimming pool 210 by positioning skimmer 20 adjacent to the edge 210 and supporting skimmer 20 by support means 111 consisting any convenient means on the edge 210, preferably simple weight lying next to the pool. Skimmer 20 extends towards the interior 206 of the pool 205 and away from edge 210 so that skimmer 20 is partially immersed longitudinally with the water level generally bisecting inlet 115. The orientation of skimmer 20 is such that the generally circular pool current generated by the force of water emitted from pump nozzle 200 flows into inlet portion 115 along with any debris 220 which may be floating on the pool's surface. The preferable orientation is for a clockwise current in the Northern hemisphere, although skimmer 20 may be oriented for either counter-clockwise or clockwise currents.

Figure 3:
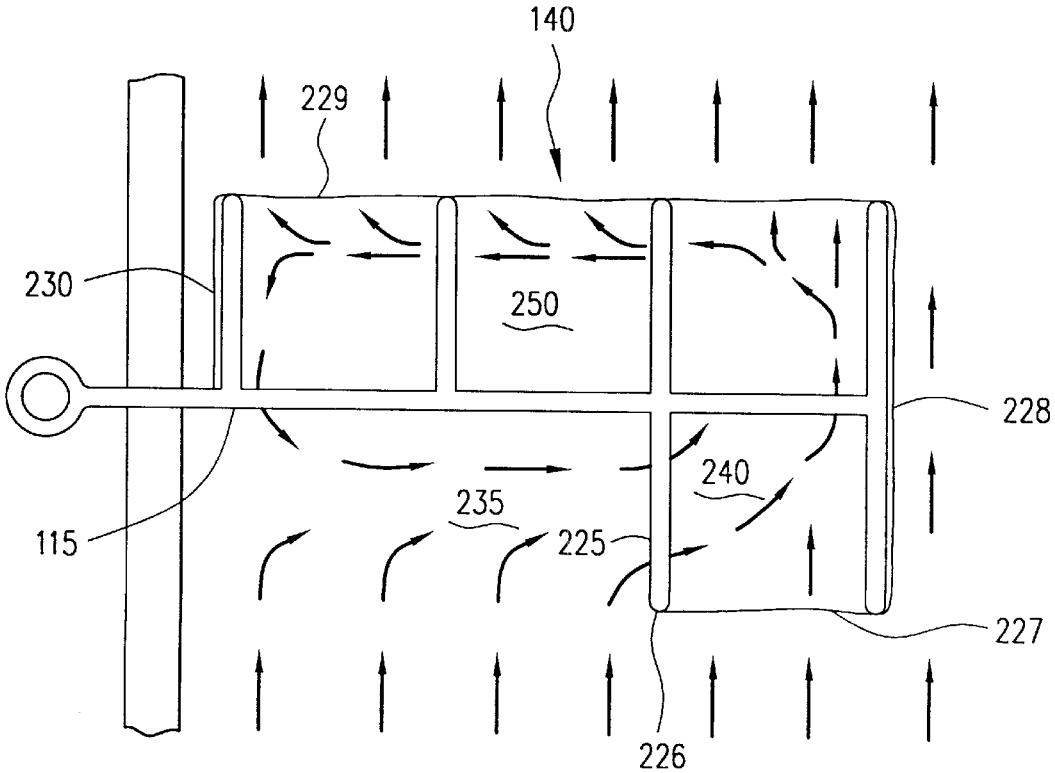
FIG. 3 presents a top view of the invention to show how it functions in the presence of a water current.

In operation, as seen in FIG. 3, it has been observed that debris collects in collection area 240 and is not returned to the swimming pool 205, regardless of how fill collection area 240 becomes. While the mechanics of this phenomenon are not well understood, it is believed that they act as follows. As the pool current carrying floating debris 220 flows towards inlet portion 115, the netting at location 227 resists the current sufficiently to create a differential in force of current measured at inlet area 235 and collection area 240. This differential in current force causes a secondary current which flows around leading point 226 of the frame, through the collection side 225, and into collection area 240. Some flow of water continues through the netting at location 227, and joining the secondary current, continues through collection area 240 into receiving area 250. The netting at point 228 prevents debris from exiting the collection area 240 and provides sufficient resistance to divert the current back into its original course. This differential in current force, thus created, causes a swirling effect to be observed. Some debris which escapes collection area 240 enters receiving area 250, where the force of the current flowing through inlet 115 causes debris 220 to collect against netting 229. As debris collects at netting 229, it begins to impede the force of the current flowing through netting 229. This causes a lessening of the current force, thereby allowing debris to float free against said current and towards inlet portion 115. However, this release of debris from the netting 229 reduces the impediment to current flow. Debris floating free from netting 229 is forced by the current flowing through inlet area 235 back through collection side 225 into collection area 240 before it can escape inlet area 235 back into the swimming pool. Eventually, the different forces acting upon the debris reach an equilibrium and the circular secondary current is observed.

While only a preferred embodiment has been illustrated and described, obvious modifications may be made within the scope of this invention and the following claims without substantially changing its functions. Accordingly, the scope of the invention should be determined not by the embodiments illustrated but by the appended claims and their legal equivalents.

The invention claimed is:

1. A skimming apparatus for removing floating debris from a surface of a pool, the pool having an edge surrounding an interior and a circulating current therein carrying the floating debris, said skimming apparatus comprising a. a support means located on the edge of the pool, said support means connected to said skimming apparatus and longitudinally positioning said skimming apparatus in the current to receive floating debris carried by the current;

b. a first frame with opposed first and second sides, said first side adjacent to the edge and receiving support from said support means, said second side positioned by said support means in the pool interior, said first frame having an inlet portion and an outlet portion both confined between said first and second sides, said support means orienting said inlet portion in a partially submerged attitude with said inlet portion generally perpendicular to the circulating current and upstream from said outlet portion, said outlet portion covered with a first permeable material for entrapment of floating debris propelled through said inlet portion by the current; and, c. a second frame extending upstream from said inlet portion, said second frame having a third side coincident with either said first or said second side and an opposing collection side, the plane of said collection side aligned generally parallel to the current and generally perpendicular to said inlet portion, the area enclosed by said second frame being in free communication with the area enclosed by said first frame, said second frame covered by a second permeable material without covering said collection side.

2. The skimming apparatus claimed in claim 1, wherein at least one of said first permeable material and said second permeable material is composed of netting.

3. The skimming apparatus claimed in claim 1, wherein said inlet portion is a generally rectangular opening defined by a horizontal upper member, a horizontal lower member, a vertical first member, and a vertical second member.

4. The skimming apparatus claimed in claim 3, wherein said members are composed of polyethylene piping material.

5. The skimming apparatus claimed in claim 3, wherein said first permeable material is supported by a plurality of spaced ribs extending downstream and connected between said horizontal upper member and said horizontal lower member.

6. The skimming apparatus claimed in claim 5, wherein said ribs and said members are composed of polyethylene piping material.

7. The skimming apparatus claimed in claim 3, wherein said second frame is comprised of a plurality of spaced ribs extending upstream and connected to said horizontal upper member and said horizontal lower member.

8. The skimming apparatus claimed in claim 7, wherein said ribs and said members are composed of polyethylene piping material.

9. The skimming apparatus claimed in claim 1, further comprising:

a. said first frame comprised of:

(1) said inlet portion defined by a horizontal upper member having a first end and a second end, a horizontal lower member having a first end and a second end, a vertical first member connecting said first ends of said horizontal members, and a vertical second member connecting said second ends of said horizontal members;

(2) a plurality of ribs extending between said horizontal lower member and said horizontal upper member, said ribs oriented downstream of said inlet portion;

(3) said first side defined by said vertical first member and one of said plurality of ribs, said second side defined by said vertical second member and one of said plurality of ribs;

b. said first permeable material covering said ribs and said sides, said outlet portion being defined by said permeable material, said ribs, and said sides, said material being removably attached to first frame by an attachment means, whereby said material may be easily replaced without damage or alteration to said first frame.

10. The skimming apparatus claimed in claim 9, wherein said attachment means consists of a plurality of hook and loop systems associated with an edge of said permeable material and encircling a selected member at plurality of locations.

11. The skimming apparatus claimed in claim 9, wherein said members are composed of polyethylene piping material.

12. A skimming apparatus for removing floating debris from a surface of a pool of water, the pool having an edge surrounding an interior and a circulating current therein, said skimming apparatus comprising:

a. a frame defining a receiving zone and a collection zone, said zones being continuously bounded at their joint perimeter by an inlet portion, an outlet portion, an internal portion, and a leading portion, said receiving zone in fluid communication with said collection zone, said receiving zone bounded by said inlet portion for receiving floating debris carried by the current and said outlet portion for permitting water to escape from the receiving zone while retaining the floating debris, said collection zone bounded by said internal portion and said leading portion and also receiving floating debris, said inlet portion and said internal portion in perpendicular relation with each other;

b. a support means for positioning said inlet portion in opposing relation to the current and said internal portion in parallel relation to the current; and c. a permeable material supported by said frame and covering said outlet portion and said leading portion, said permeable material covering said leading portion encouraging a circular secondary current between said receiving zone and said collection zone by providing resistance to the current encountering said leading portion;

whereby a differential in current force between said collection zone and said current is induced by the resistance of said permeable material covering said leading portion, thereby inducing a fraction of the floating debris to divert from the current through said internal portion into said collection zone to be captured therein, the remaining fraction continuing with the current through said inlet portion where is it captured by the circular secondary current between said receiving zone and said collection zone.

13. The skimming apparatus claimed in claim 12, wherein said permeable material is comprised of netting.

14. The skimming apparatus claimed in claim 12, wherein said permeable material is attached to said frame by means of a standard hook and loop system, whereby said permeable material is easily removable from said frame for purposes of cleaning.

15. The skimming apparatus claimed in claim 12, wherein said frame is comprised of polyethylene piping material.

16. A skimming apparatus for removing floating debris from a surface of a pool of water, the pool having an edge surrounding an interior and a circulating current therein, said skimming apparatus comprising:

a. a support means rigidly positioning a frame in opposing relation to the current so that the surface generally bisects said frame, said frame being thus partially submerged and extending from the edge into the interior of the pool;

b. said frame with an inlet portion positioned generally perpendicular to said current to receive floating debris brought by the current therethrough and an outlet portion covered with a first permeable material to retain floating debris from the current passing therethrough, said frame also with a first end and a second end;

c. a collection basket positioned at said first end of said frame, said basket covered with a second permeable material providing a relatively low resistance to current flow therethrough, said basket having an open end with a leading edge, said open end perpendicular to said inlet portion and facing said second end, said second permeable material inducing a secondary circular lateral current by impeding water flow through said collection basket sufficiently to cause a differential in current force between the current flowing across said open end and current flowing through said second permeable material covering said collection basket, whereby floating debris is urged into said collection basket by said secondary lateral current and free flow of water through said outlet portion is maintained by said secondary circular lateral current which tends to bring floating debris accumulating at and inhibiting current flow through said outlet portion into said collection basket.

17. The skimming apparatus claimed in claim 16, wherein said permeable material is comprised of netting.

18. The skimming apparatus claimed in claim 16 wherein said frame is comprised of polyethylene piping.

19. The skimming apparatus claimed in claim 16, wherein said support means includes a float.

20. A method for removing floating debris from a pool of water having an edge and a current therein, said method comprising:

a. positioning adjacent to the edge of the pool a frame having an inlet portion generally perpendicular to said current and an outlet portion covered with a permeable material, said frame with a first end and a second end, so that floating debris is brought through said inlet portion by the current;

b. positioning at said first end a collection basket covered with a permeable material providing a relatively low resistance to current flow therethrough and having an open end with a leading edge, said open end perpendicular to said inlet portion and facing said second end;

c. inducing by the choice of said permeable material a secondary circular lateral current, whereby said permeable material impedes water flow through said collection basket sufficiently to cause a differential in current force between the current flowing across said open end and current flowing through said collection basket;

d. collecting floating debris in said collection basket, the floating debris being urged into said collection basket by said secondary lateral current; and e. maintaining free flow of water through said outlet portion by means of said secondary circular lateral current which tends to bring floating debris accumulating at said outlet portion into said collection basket.

* * * * *